US005321761A

United States Patent [19]

Kitanishi

[11] Patent Number: 5,321,761

[45] Date of Patent: Jun. 14, 1994

[54] PIEZOELECTRIC SOUND GENERATOR AND METHOD OF ITS MANUFACTURE

[75] Inventor: Shinichiro Kitanishi, Kagoshima, Japan

[73] Assignee: Kyocera Corporation, Kyoto, Japan

[21] Appl. No.: 809,545

[22] PCT Filed: May 24, 1991

[86] PCT No.: PCT/JP91/00719

§ 371 Date: Jan. 24, 1992

§ 102(e) Date: Jan. 24, 1992

[87] PCT Pub. No.: WO91/19372

PCT Pub. Date: Dec. 12, 1991

[30] Foreign Application Priority Data

May 26, 1990 [JP] Japan ..... 2-55023[U]
Jun. 29, 1990 [JP] Japan ..... 2-174064

[51] Int. Cl.[5] ..... H04R 25/00

[52] U.S. Cl. ..... 381/190; 381/173; 381/114; 310/317

[58] Field of Search ..... 381/190, 114, 173, 191, 381/99; 310/324, 317; 379/52, 443, 444; 330/174; 340/384 E

[56] References Cited

U.S. PATENT DOCUMENTS 4,157,459 6/1979 Bush et al. ..... 379/375
4,295,099 10/1981 Weidler ..... 381/205
4,596,899 6/1986 Wojcik et al. ..... 379/52

FOREIGN PATENT DOCUMENTS 0094300 6/1983 Japan ..... 381/173
0021694 2/1985 Japan ..... 381/190
61-88699 5/1986 Japan .
61-214644 9/1986 Japan .
61-278247 12/1986 Japan .
4063099 2/1992 Japan ..... 381/190
2200514 8/1988 United Kingdom ..... 381/190
9119372 12/1991 World Int. Prop. O. ..... 381/190

*Primary Examiner*—Curtis Kuntz
*Assistant Examiner*—Huyen D. Le
*Attorney, Agent, or Firm*—Spensley Horn Jubas & Lubitz

[57] ABSTRACT

A piezoelectric sound generator includes a piezoelectric device consisting of a metal diaphragm and a piezoelectric porcelain plate affixed to the diaphragm, a pair of connecting members having resistors connected to the piezoelectric device in series, a leakage magnetic flux coil connected in parallel to the piezoelectric device and the resistors in series, and a resin case. The resin case encases the piezoelectric device and containing the resistors, and has a spool for retaining the leakage magnetic flux coil. In addition, the resin case embraces a portion of the connecting members. This piezoelectric sound generator is manufactured by the steps of: soldering the resistors to the connecting members; forming the resin case in an insertion mold into which the connecting members have been placed, whereby a portion of the connecting members is embraced by the resin case; and attaching the piezoelectric device and the coil to the resin case. The sound generator thus obtained is so accommodated by a handset having sound emission holes that a cavity is defined by the piezoelectric device, the resin case and the handset.

35 Claims, 8 Drawing Sheets

PIEZOELECTRIC SOUND GENERATOR AND METHOD OF ITS MANUFACTURE

DESCRIPTION

1. Technical Field

The present invention relates to a piezoelectric sound generator and a method of its manufacture. More specifically, it relates to a piezoelectric sound generator for utilization in a telephone receiver incorporating a leakage magnetic flux coil for hearing aid users.

2. Background Art

Japanese Patent Laying-Open No. 102496/1988 and Japanese Patent Laying-Open No. 102497/1988 disclose piezoelectric sound generators provided in telephone receivers for people using hearing aids. The generators have a coil wound around a case containing a piezoelectric device. The coil generates a leakage magnetic flux when supplied with an electric current. The leakage magnetic flux then induces the pickup coil in a user's hearing aid to generate current.

The piezoelectric device of the conventional piezoelectric sound generator is enclosed in a case which is contained in a telephone receiver, and the coil is disposed inward of the piezoelectric device, or toward the side nearer a user's ear. The piezoelectric device and the coil are connected in parallel in order to bring about both acoustic pressure characteristics and leakage magnetic flux characteristics which are satisfactory. Additionally, a single resistor is provided exterior of the generator, connected in series to a terminal of the piezoelectric device. The resistor serves to regulate the acoustic pressure level of the piezoelectric device and to maintain the leakage magnetic flux at sufficient strength.

However, the sound waves reproduced by a piezoelectric device of the foregoing structure tend to be deformed, due to an imbalance in the impedance between the two terminals of the device. Moreover, very high voltages generated in the piezoelectric device by static electricity or by strong external mechanical forces may deteriorate the IC's of an associated driver circuit.

The piezoelectric device of the conventional piezoelectric sound generator comprises a metal diaphragm, a piezoelectric porcelain affixed to the metal diaphragm, and a pair of anterior and posterior metal cases containing the piezoelectric device so as to form anterior and posterior cavities.

A plurality of sound-emission holes are formed in the anterior metal case, and formed in the posterior metal case is an acoustic-pressure relief hole over which a mesh sheet providing acoustic resistance is affixed. The pair of metal cases containing the piezoelectric device are installed in the handset of a telephone. An auxiliary cavity is formed between a the handset having sound-emission holes and the anterior metal case.

The sound waves emitted from the piezoelectric device of this sound generator travel to the ear of a user through the anterior cavity formed between the piezoelectric device and the anterior metal case, and the auxiliary cavity formed between the anterior metal case and the handset wall. Accordingly, the dimensional volume of these cavities affects the acoustic characteristics therein.

Handsets of reduced size and thickness have been developed for portable telephones which have come into widespread use. However, in a handset employing the conventional piezoelectric sound generator, the auxiliary cavity formed between the metal cases and the handset in addition to the pair of cavities formed within the metal cases imposes an unsuitable limitation on the extent to which its thickness can be reduced.

Since it is highly desirable that the parts built in a receiver be reduced in size, a piezoelectric buzzer has been disclosed in Japanese Patent Laying-Open No. 96799/1990 wherein its terminals are integrally set into a resin case containing the piezoelectric device, for application in a telephone set.

However, electronic components must be soldered to the terminals of this structure, which soldering raises the temperature of the terminals to approximately 200° C. to 300° C., and which in turn may deform the portions of the resin case into which the terminals are contained. Should the resin material become deformed, the connection between the piezoelectric device and the terminals may be affected, causing deterioration of the characteristics desired and weakening the device mechanically.

Although a heat-resisting resin capable of withstanding the high temperatures in soldering may be employed in order to solve the above problem, large apertures for attachment of electronic components must still be formed in the resin case, such that it cannot be adequately reduced in size.

SUMMARY OF THE INVENTION

It is an object of the present invention to provide a piezoelectric device capable of high-fidelity sound reproduction which, while retaining satisfactory acoustic pressure levels, minimizes the possibility of adverse effects on an external drive circuit.

It is another object of the present invention to preserve satisfactory acoustic pressure levels in a piezoelectric device of reduced size.

It is yet another object to provide a method the manufacture of a piezoelectric sound generator of reduced size which can be easily assembled.

It is yet another object of the present invention to reduce size of a piezoelectric sound generator while maintaining its acoustical characteristics.

A piezoelectric sound generator according to one aspect of the present invention is composed of a piezoelectric device comprising a metal diaphragm and a piezoelectric porcelain plate affixed to the metal diaphragm, resistors connected in series to both electrodes of the piezoelectric device, and a leakage magnetic flux coil connected in parallel to the series circuit of the piezoelectric device and the resistors.

When sound signals are input to this piezoelectric sound generator, current flows through the coil and the piezoelectric device. Consequently, leakage magnetic flux is emitted from the coil, and sound waves are generated by the piezoelectric device in correspondence with the input electric signals. Due to the fact that the resistors are connected in series to both electrodes of the piezoelectric device, and that the coil is connected in parallel therewith, the applied voltage to the piezoelectric device scarcely dips, whereby the acoustic pressure characteristics of the piezoelectric device are maintained. Furthermore, since there are resistors between either electrode of the piezoelectric device and an external circuit, sound waves from the piezoelectric device are minimumally deformed by the effects of an external circuit, and the external circuit is at the same time well protected from strong signal impulses due to jarring of the piezoelectric device.

A piezoelectric sound generator according to another aspect includes a piezoelectric device, a leakage magnetic flux coil, connecting members to which electronic components are attached for connecting said piezoelectric device and the leakage magnetic flux coil, and a resin case. The resin case has an encasing portion in which the piezoelectric device is retained, and a containing portion for containing electronic components, which includes a spool for the leakage magnetic flux coil. The connecting members have portions thereof fixed integrally into the case resin.

The configuration of the spool and the electronic-component containing portion of the case are such that they enable this piezoelectric sound generator to be easily manufactured and at reduced size. Accordingly, a smaller size piezoelectric sound generator can be manufactured at low cost. Furthermore, since portions of the connecting members are fixed integrally into the case resin, the connecting members are firmly anchored in the case and stability of the joint between the connecting members and the piezoelectric device is well maintained.

The method of manufacturing the piezoelectric sound generator of this invention includes the steps of: soldering the electronic components to the connecting members; forming a resin case in a resin insertion mold, wherein the connecting members have been placed such that the portion connecting members having the electronic components is molded into the case resin; and attaching the piezoelectric device and the coil to the resin case.

Thus the connecting members with the electronic components attached are fixed integrally into the case resin, and the resin case is not subject to a high-temperature heat of soldering after it is formed. This ensures proper fixation of the connecting members to the resin case. Therefore, the mechanical strength of the joint between the piezoelectric device and the connecting members are not subject to any impairment by the heat of soldering.

A piezoelectric-type receiver according to the subject invention in another aspect includes a piezoelectric device having a metal diaphragm and a piezoelectric porcelain plate affixed to the metal diaphragm, a support frame containing the piezoelectric device and defining a first cavity therewith, a hand-case perforated by sound-emission holes, containing the support frame and defining a second cavity with the piezoelectric device.

This piezoelectric receiver does not have a case which would define an auxiliary cavity between the piezoelectric device and the hand-case, and the sound waves emitted from the piezoelectric device travel through the holes in the hand-case. Thus, due to the omission of the case conventionally provided between the piezoelectric device and the hand-case, the piezoelectric receiver in this aspect of the embodiment can be reduced in size and in thickness.

These and other objects and advantages of the present invention will be more fully apparent from the following detailed description.

DESCRIPTION OF THE PREFERRED EMBODIMENT

Embodiment 1

Figure 1:
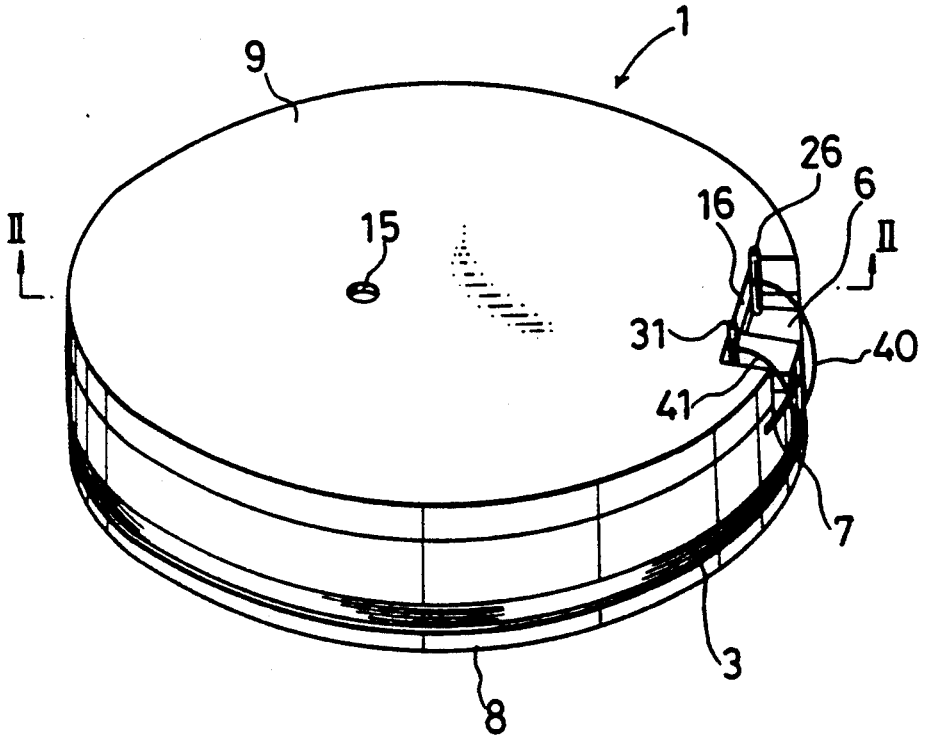
FIG. 1 is a perspective view of a piezoelectric sound generator according to the present invention.
Figure 2:
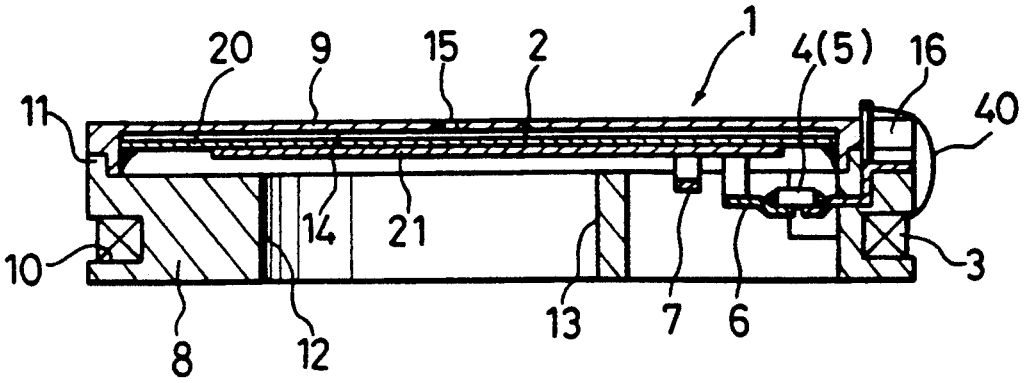
FIG. 2 is a sectional view taken along the line II—II of FIG. 1.

FIGS. 1 and 2 show a piezoelectric sound generator 1 which includes a piezoelectric device 2, a leakage magnetic flux coil 3, and chip type resistors 4 (and 5) in connection through connecting members 6 and 7. The piezoelectric device 2, the chip resistors 4 (and 5) and the connecting members 6 and 7 are captured within a cavity formed by a resin case 8 and a cover 9, and the coil 3 is wound around the periphery of the resin case 8.

Figure 3:
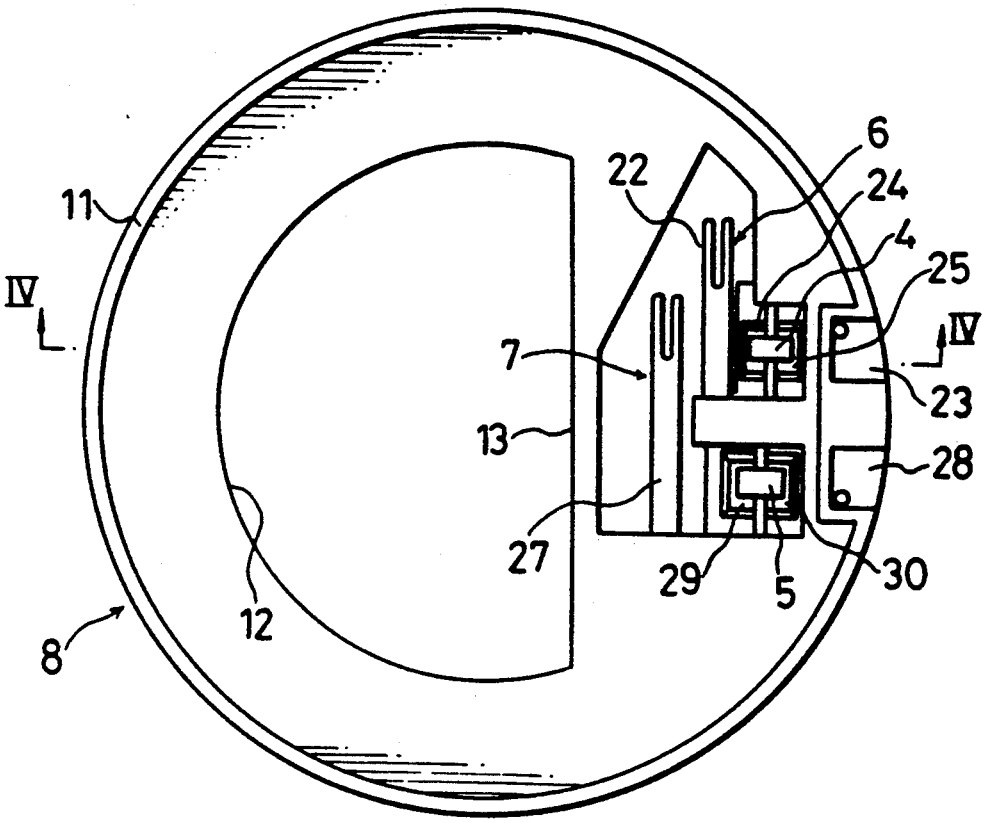
FIG. 3 is a plan view of a resin case of an embodiment herein.
Figure 4:
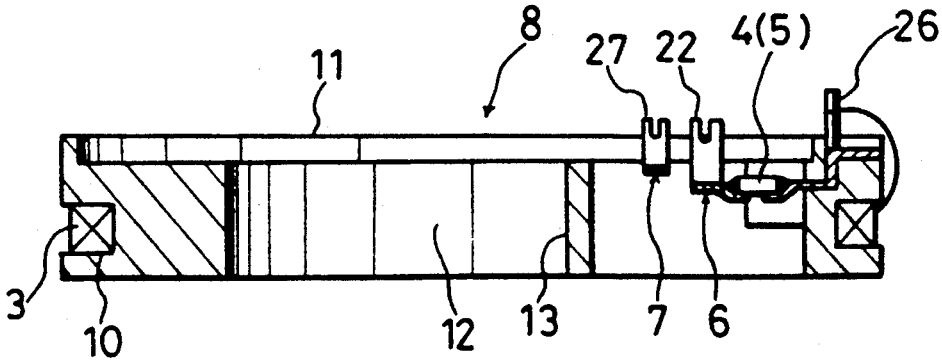
FIG. 4 is a sectional view taken along the line IV—IV of FIG. 3.

FIGS. 3 and 4 show the resin case 8. The resin case 8 is made of a resin such as ABS resin, and has a spool 10 consisting of a groove girdling its circumferential surface, and a rim 11 for mating with the cover 9 (FIGS. 1 and 2). The resin case 8 also includes a central cutout 12 for effecting balance acoustic pressure characteristics. A partition wall 13 to ensure the resin case 8 against deformation is formed across the cutout 12. Their bases of connecting members 6 and 7 are integrally fixed into the resin case 8 in its molding.

The cover 9 is also made of ABS resin, and is disc-shaped as shown in FIG. 1. The cover 9 has a cavity 14 (FIG. 2) opening toward the resin case 8, and the piezoelectric device 2 is placed within the cavity 14. Centrally located in the cover 9, a hole 15 for dumping acoustic pressure fluctuation is formed. A notch 16 is formed in a peripheral portion of the cover 9 adjacent the connecting members 6 and 7, thereby exteriorly exposing portions of their bases.

The piezoelectric device 2 includes a metal plate 20 as a diaphragm, and a piezoelectric porcelain 21 affixed to one side of the metal plate 20. The piezoelectric porcelain 21 comprises a polarized porcelain disc and electrodes (not shown) formed on either side. The metal plate 20 is, for example, 0.1 mm in thickness, 30 mm in diameter, and made of 42 Ni-Fe alloy. The piezoelectric porcelain 21 is, for example, 0.05–0.1 mm in thickness, 23 mm in diameter, and made of PZT piezoelectric material. The electrodes (not shown) of the piezoelectric porcelain 21 are made of silver, for example.

Figure 5:
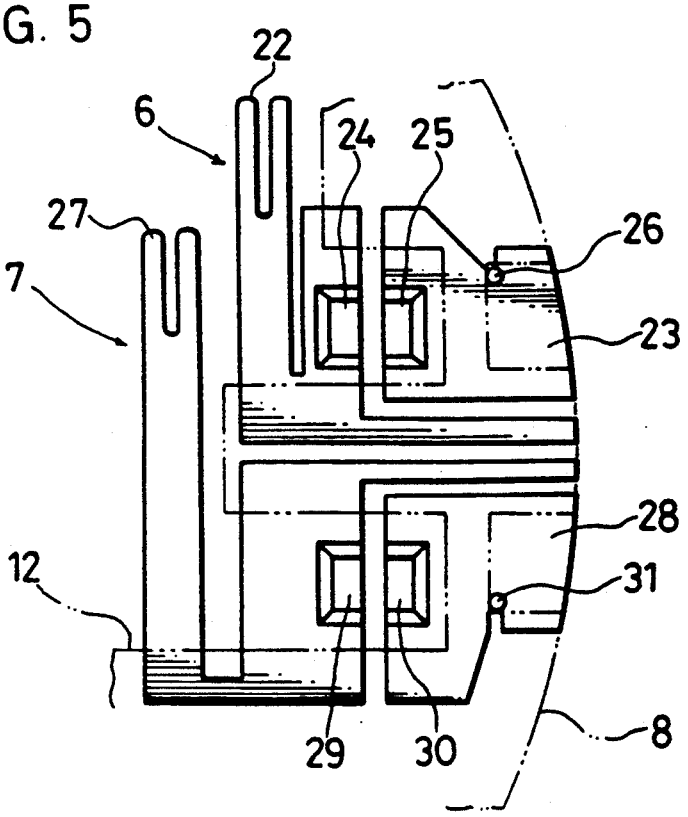
FIG. 5 is a plan view of connecting members.

The connecting members 6 and 7 are metal plates made of silver-plated phosphor bronze. As shown in FIG. 5, the connecting member 6 comprises a spring terminal 22 and an external connection terminal 23. The pair of terminals 22 and 23 have indentations 24 and 25 for receiving the chip resistor 4 exposed in the cutout 12 of the case 8 (FIGS. 3 and 4). Projecting from the external connecting terminal 23 is a pin 24 in the portion exposed to the exterior. Meanwhile, that portion of the connecting member 6 which is not the exposed portion of the spring terminal 22 nor of the external connecting terminal 23 is embraced by the resin of the case 8 through its molding process, whereby the connecting body 6 is firmly anchored.

The connecting member 7 comprises a spring terminal 27 and an external connecting terminal 28. The pair of terminals 27 and 28 have indentations 29 and 30 for receiving the chip resistor 5 exposed in the cutout 12 of the case 8 (FIGS. 3 and 4). Projecting from the external connecting terminal 28 is a pin 31 in the portion exposed to the exterior. Meanwhile, that portion of the connecting member 7 which is not the exposed portion of the spring terminal 27 nor of the external connecting terminal 28 is embraced by the resin of the case 8 through its molding process, whereby the connecting member 7 is firmly anchored.

As shown in FIG. 3, the chip resistor 4 is set into the indentations 24 and 25, whereby the spring terminal 22 and the external connecting terminal 23 of the connecting member 6 are in electrical connection. The chip resistor 5 is set into the indentations 29 and 30, whereby the spring terminal 27 and the external connecting terminal 28 of the connecting member 7 are in electrical connection.

The spring terminals 22 and 27 extend upward as shown in FIG. 4, and their tips elastically press against the piezoelectric device 2 as shown in FIG. 2. More specifically, the connecting member 7 makes contact with the electrode (not shown) formed on the lower surface of the piezoelectric porcelain 21, and the connecting body 6 makes contact with the metal plate 20.

The leakage magnetic flux coil 3 is wound on the spool portion 10 of the resin case 8, and has a predetermined number of turns. As shown in FIG. 1, an initial end 40 and a terminal end 41 of the coil 3 are connected to the pin 26 and the pin 31, respectively.

Figure 6:
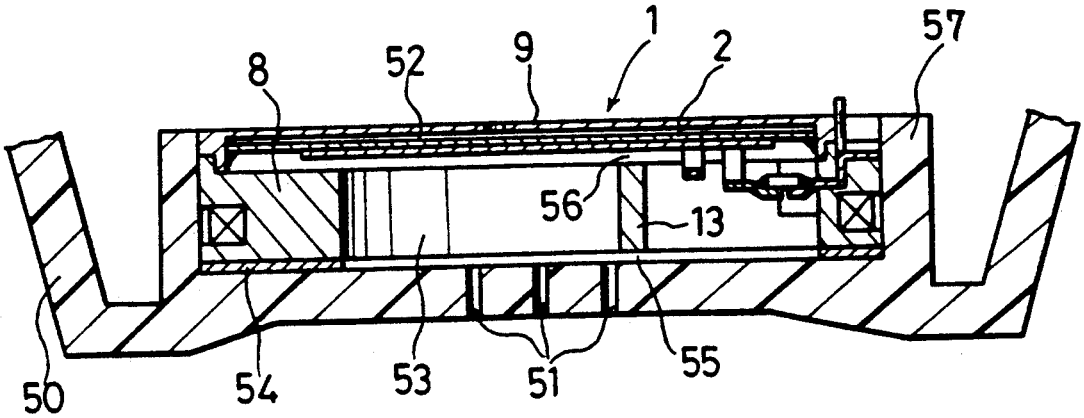
FIG. 6 is a partly in sectional view showing the piezoelectric sound generator installed in a handset.

The aforedescribed piezoelectric sound generator 1 is, as shown in FIG. 6, fixed to a handset 50 of a telephone set. The handset 50 has a tubular rim 57 extending from a portion having sound-emission perforations 51. This tubular rim 57 accommodates the piezoelectric sound generator 1. Consequently, in addition to the first cavity 52 defined by the cover 9 and the piezoelectric device 2, a second cavity 53 is defined by the device 2, the resin case 8 and the handset 50. Sound waves emitted from the piezoelectric device 2 travel to the ear of a user through the second cavity 53 and the perforations 51.

The handset 50 is made of a hard resin such as ABS resin or PBT resin. There is a rubber seat 54 between the piezoelectric sound generator 1 and the perforated portion of the handset 50, which seals the region between the piezoelectric sound generator 1 and the handset 50.

The partition wall 13 forms a gap 55 at the end adjacent the handset 50 and a gap 56 at the opposite end, adjacent the piezoelectric device 2, so that the partition wall 13 does not acoustically bifurcate the second cavity 53. This partition wall 13 solely ensures the piezoelectric sound generator 1 against deformation, such that it does not destabilize the acoustic characteristics.

It is preferable that the ratio of the volume of that portion of the second cavity 53 over the sound emission perforations 51 to the volume of that portion containing the connecting bodies 6 and 7 be between 1:½ and 1:¼. If the latter is greater than one-half the former, the acoustic pressure level drops extremely. If the latter volume is less than one quarter the former, the partition wall 13 will not be in a position to sufficiently restrain the sound generator 1 against deformation.

Figure 7:
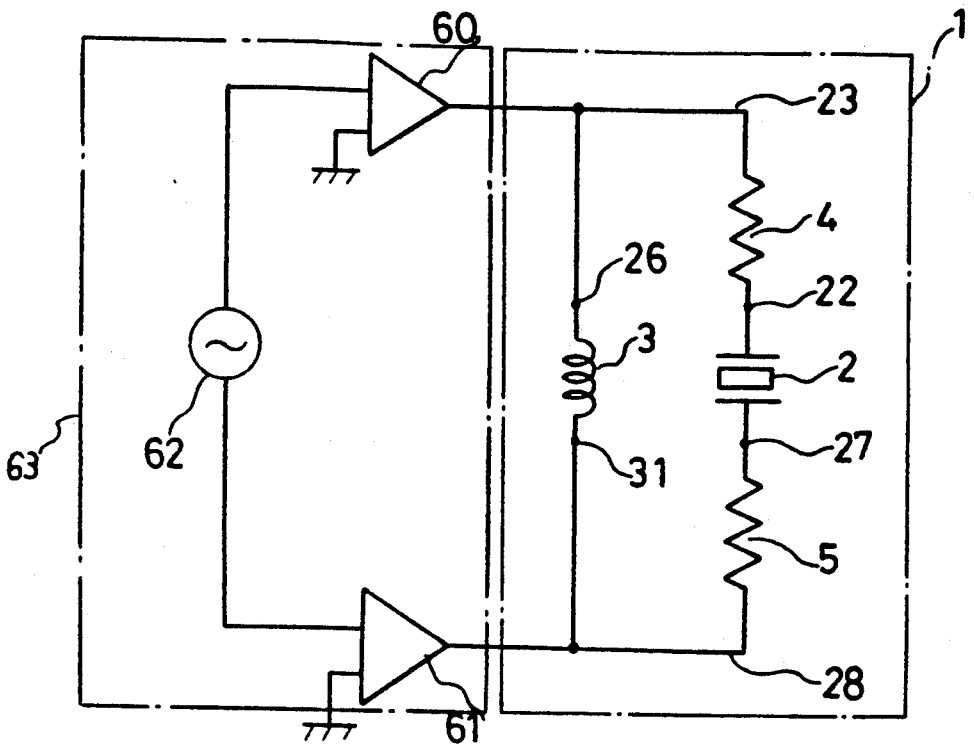
FIG. 7 is an equivalent circuit diagram showing a circuit structure of the piezoelectric sound generator.

FIG. 7 shows an equivalent circuit of the piezoelectric sound generator 1. The chip resistors 4 and 5 are connected in series to the electrodes of the piezoelectric device 2 through the spring terminals 22 and 27 respectively. The coil 3 is connected in parallel across the series circuit of the piezoelectric device 2 and the chip resistors 4 and 5. This sound generator 1 may be operated by connecting the external connecting terminals 23 and 28 to a Balanced Transformerless Amplifier circuit (or BTL circuit) 63 which includes a pair of operational amplifiers 60 and 61 and a voice signal source 62.

In the BTL circuit 63, signals from the voice signal source 62 are amplified by operational amplifiers 60 and 61, wherein the amplification by the op-amp 60 is without phase shift, and that of the op-amp 61 is with a phase shift of 180°.

The resistors 4 and 5 serve to protect the operational amplifiers 60 and 61 from high voltage which might happen to be generated in the piezoelectric device 2 by external shock. If the resistor 5, for example, were to be omitted from the circuit of FIG. 7 (in which the resistors 4 and 5 are connected in series to either electrodes of the piezoelectric device 2), the impedance of the operational amplifier 61 would be reduced by the resistance of the resistor 5. The ill-balanced impedance would then distort the voltage applied to the piezoelectric sound generator 1, such that the voice reproduction would become in accurate.

If the resistors 4 and 5 were connected directly to the output terminals of the operational amplifiers 60 and 61 instead of their being placed within the piezoelectric sound generator 1, the voice signals amplified at the BTL circuit 63 would attenuate strongly. Since the resistors 4 and 5 are placed adjacent the piezoelectric device 2 and connected thereto in this embodiment, the voltage drop at both resistors 4 and 5 can be ignored, due to the very high impedance of the piezoelectric device 2.

Figure 8:
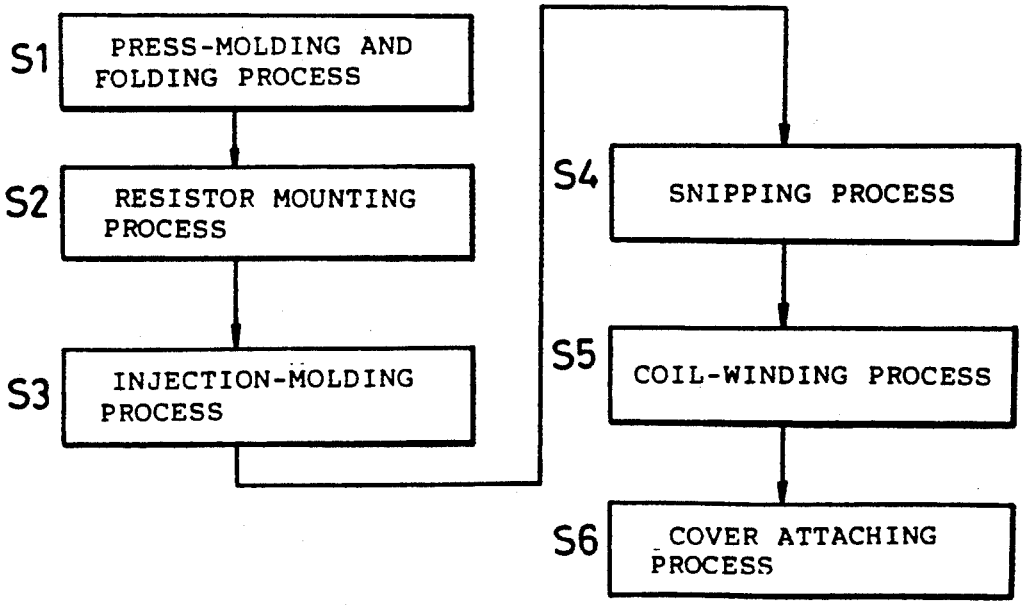
FIG. 8 is a flow chart showing piezoelectric sound generator manufacturing steps.

Now, the manufacturing steps of aforementioned piezoelectric sound generator 1 will be described with reference to the flow chart shown in FIG. 8.

Figure 9:
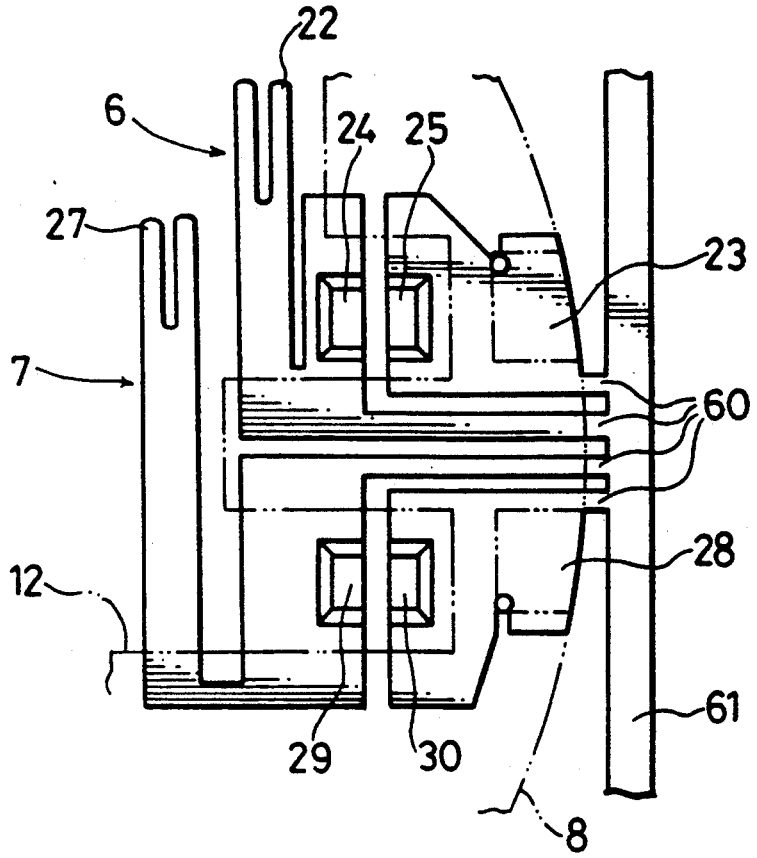
FIG. 9 is a plan partial view showing a stage in the manufacturing steps of FIG. 8.

At first step S1, the connecting bodies 6 and 7 are manufactured from metal plates by a press-molding and folding process. As shown in FIG. 9, the spring terminals 22 and 27 and the external connecting terminals 23 and 28 of the manufactured connecting bodies 6 and 7 are integrally connected to a frame 61 through lead portions 60. Thus, a plurality of connecting bodies 6 and 7 integrally connected to a stock frame 61 may be obtained in manufacture.

Next, at second step S2, the chip resistors 4 and 5 are set into the resistor-receiving indentations 24, 25, 29 and 30 in electrical connection. Soldering paste is first placed on the deeper surfaces of the indentations 24, 25, 29 and 30. Then, the chip resistors 4 and 5 are placed into the indentations 24, 25, 29 and 30, and heated in a reflow soldering furnace, whereby they are set accurately. The soldering paste is kept from flowing out by the indentations 24, 25, 29 and 30.

Figure 10:
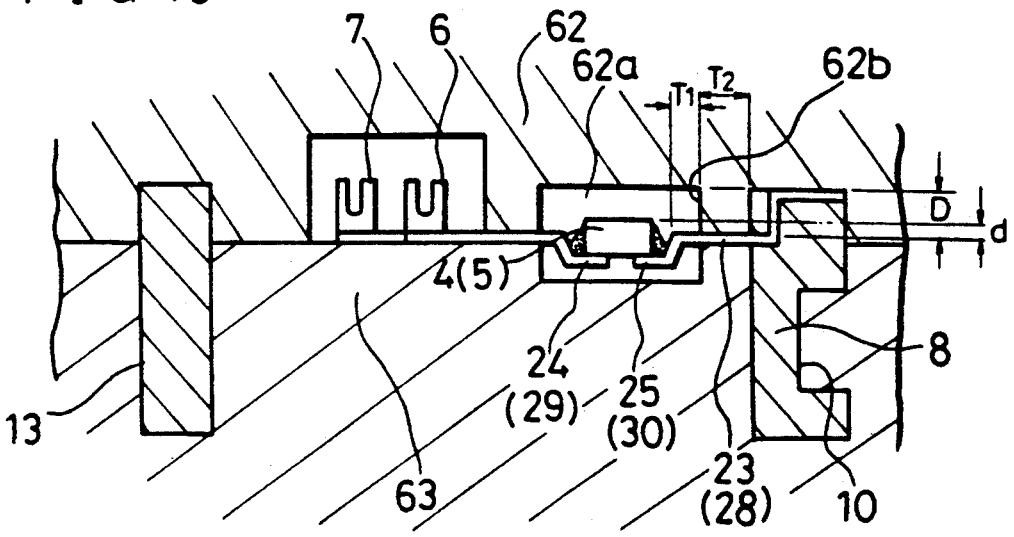
FIG. 10 is a partly in sectional view showing another state in the manufacturing steps.

At third step S3, a resin-injection molding process is carried out. As seen in FIG. 10, injection-mold halves 62 and 63 clamp vertically the connecting members 6 and 7. Provided in these mold halves 62 and 63 is a cavity wherein the resin case 8 is formed, and additional cavities whereby the connecting bodies 6 and 7 are left exposed. The pair of injection-mold halves 62 and 63 molds the resin case 8 such that the connecting members 6 and 7 are partially embraced and are anchored into the resin case 8. The accurate positioning of the chip resistors 4 and 5 by the indentations 24, 25, 29 and 30 ensures that they are not damaged by the injection-mold halves 62 and 63.

At fourth step S4, the stock frame 61 including the lead portions 60 exposed from the resin case 8 is snipped from the resin case 8, whereby each resin case 8 of a manufactured series becomes freed. This leaves the connecting bodies 6 and 7 and the spring terminal 22 and the external connecting terminal 23 electrically connected solely through the chip resistors 4; with the spring terminal 27 and the external connecting terminal 28 electrically connected solely through the chip resistor 5.

At fifth step S5, an electrical conductor is wound onto the spool 10 of the resin case 8, forming the coil 3. Then, the initial end 40 and the terminal end 41 of the coil 3 are connected onto the pins 26 and 31 of the connecting members 6 and 7.

At sixth step S6, the cover 9 in which the piezoelectric device 2 has been accommodated is attached to the resin case 8, whereby the spring terminals 22 and 27 of the connecting bodies 6 and 7 come elastically into contact with the piezoelectric device 2, forming the circuit shown in FIG. 7.

The assembled piezoelectric sound generator 1 is, as shown in FIG. 6, accommodated into the tubular rim 57 of the handset 50.

Due to the fact that the connecting members 6 and 7 are embraced by the resin case 8 through the molding process after the chip resistors 4 and 5 are soldered to the connecting members 6 and 7 in the aforementioned manufacturing steps, high-temperature heat of the soldering process is not applied to the resin case after its manufacture, eliminating the risk of heat-deformation to the resin case 8 anchoring the connecting bodies 6 and 7. Thus, secure electrical contact of the piezoelectric device 2 with the connecting members 6 and 7 is ensured, and the structural strength of the resin case 8 in anchoring the connecting members 6 and 7 is not degraded. In addition, the cost of manufacturing is reduced because it is not necessary to employ a heat-resisting resin as the material of the resin case 8.

Referring to FIG. 10, it is desirable that the distance $T_1$ be 0.3 mm or longer, the distance $T_2$ be the same as the height D or greater, and that the height d be $\frac{2}{3}$ of the height D or less, wherein the height d is the height of the upper surfaces of the chip resistors 4 and 5 from the mating surface of the injection-mold half 62, the height D is the height of the upper surface of the cavity **62*a* of the mold-half 62 from the same mating surface, the distance $T_2$ corresponds to the thickness of the side wall 62*b* of the cavity portion 62*a*, and the distance $T_1$ is the distance from the side wall 62*b* to the indentations 25 and 30. Additionally, it is preferable that $T_1+T_2 \leqq D$; and it is further preferable that $T_1+T_2$ be 1 mm, the height d be 4 mm or less, and the height D be 1 mm. By conforming to these specifications, the resin case 8 is less subject to damage by the mold halves 62 and 63** when they are removed off.

Other electronic components, such as capacitors, may be used instead of the chip resistors 4 and 5, if necessary.

Embodiment 2

Figure 11:
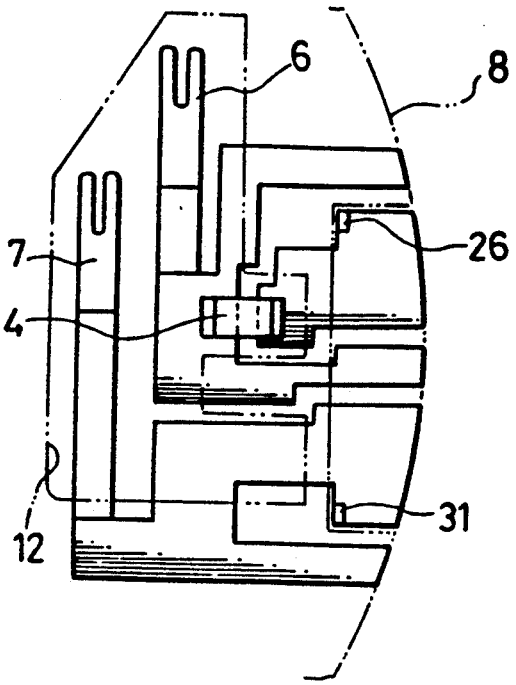
FIG. 11 is a view corresponding to FIG. 5 showing another embodiment.
Figure 12:
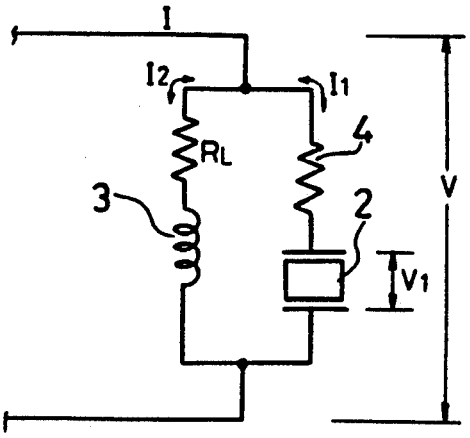
FIG. 12 is an equivalent circuit diagram of the embodiment of FIG. 11.

A connective structure to a piezoelectric device shown in FIG. 11 includes a chip resistor 4 mounted on its connecting member 6, but has no chip resistor on its connecting member 7. A corresponding circuit diagram is shown in FIG. 12, in which the resistance $R_L$ is the internal resistance of the coil 3.

That the resistance of resistors 4 and 5 in Embodiment 1 and the resistor 4 in this embodiment are in series with the piezoelectric device 2 minimizes the voltage drop applied thereto, ensuring stability of the acoustic pressure characteristics of the piezoelectric device 2.

Figure 13:
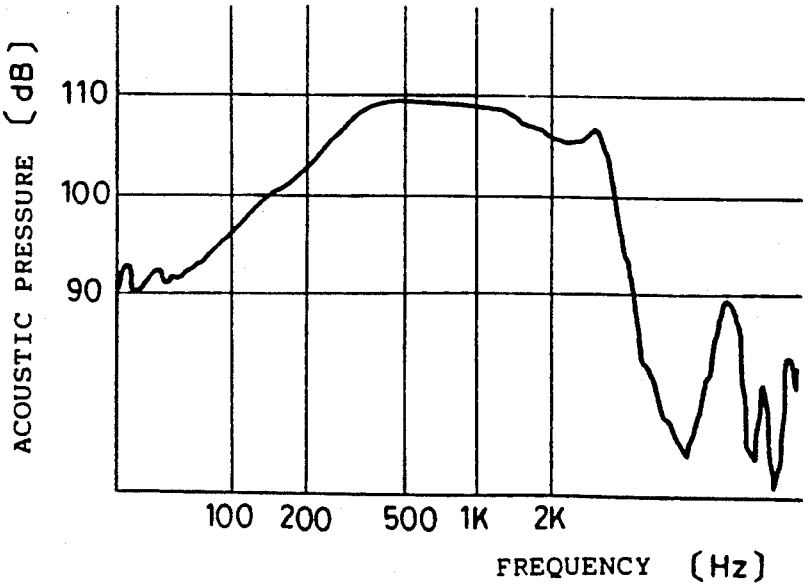
FIG. 13 is a graph illustrating acoustic characteristics of the embodiment of FIG. 11.

FIG. 13 shows an example of the acoustic pressure characteristics of a piezoelectric sound generator 1 according to this embodiment. As is apparent from FIG. 13, the sound generator 1 shows a high acoustic pressure level of about 108 dB within a range of 300 Hz to 1500 Hz in response to speaking signals of 1 Vrms'.

Embodiment 3

Figure 14:
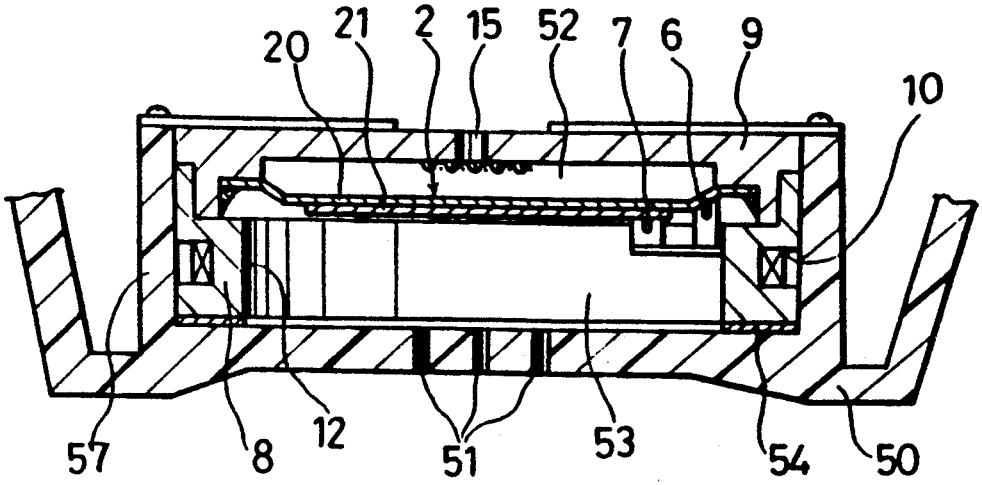
FIG. 14 is a view corresponding to FIG. 6 of yet another embodiment.

A piezoelectric sound generator 70 as shown in FIG. 14 does not include the chip resistors 4 and 5.

Figure 15:
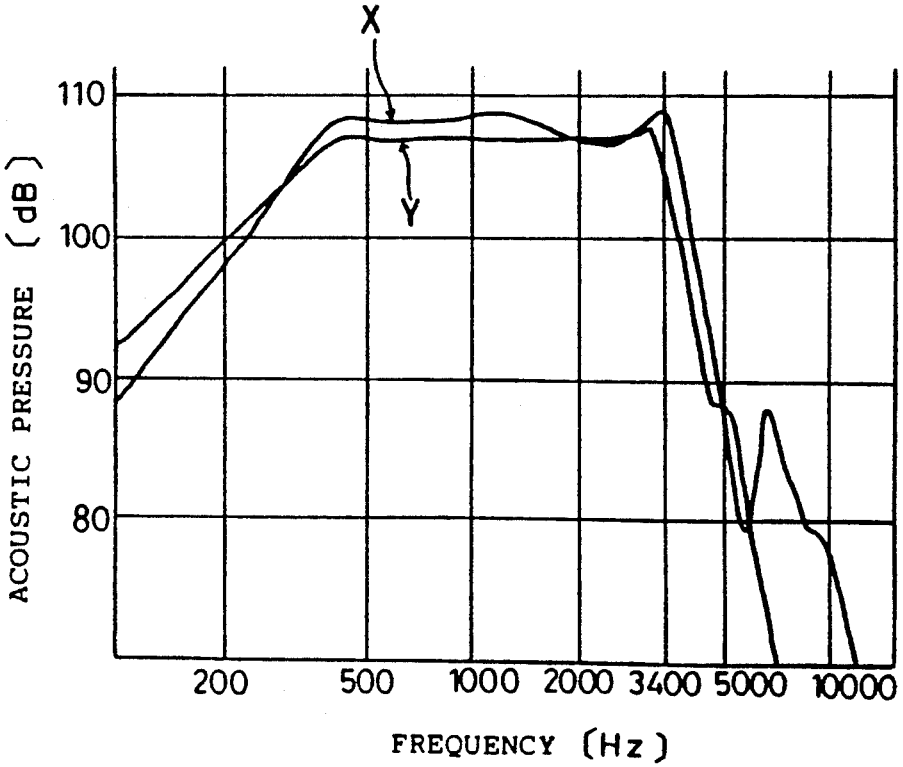
FIG. 15 is a graph illustrating acoustic characteristics of the embodiment of FIG. 14.

FIG. 15 shows the acoustic characteristics of the embodiment shown in FIG. 14. Line X represents the characteristics of this embodiment and line Y represents conventional characteristics.

As is apparent from FIG. 15, in the frequency range of 500 Hz–3400 Hz necessary for ordinary speech, the acoustic pressure level is higher in this embodiment than is conventional. This is due to the fact that there is no case wall between the piezoelectric device 2 and the perforations 51 of the handset 50, and the sound emitted from the piezoelectric device 2 reaches the perforations 51 of the handset 50 without obstacle.

Generally, as the volume of the cavity 53 is reduced, the frequency range within which sufficient acoustic pressure level is obtained becomes narrower. In this embodiment, however, the volume of the cavity 53 can be made smaller than is conventional since the acoustic pressure level is higher than is conventional within the generally desired acoustic bandwidth. In other words, the cavity 53 can be reduced in size while at the same time maintaining acoustic characteristics equivalent to those achieved conventionally. For example, the volume of the cavity 53 may be formed to be 2.0 cc or smaller.

Figure 16:
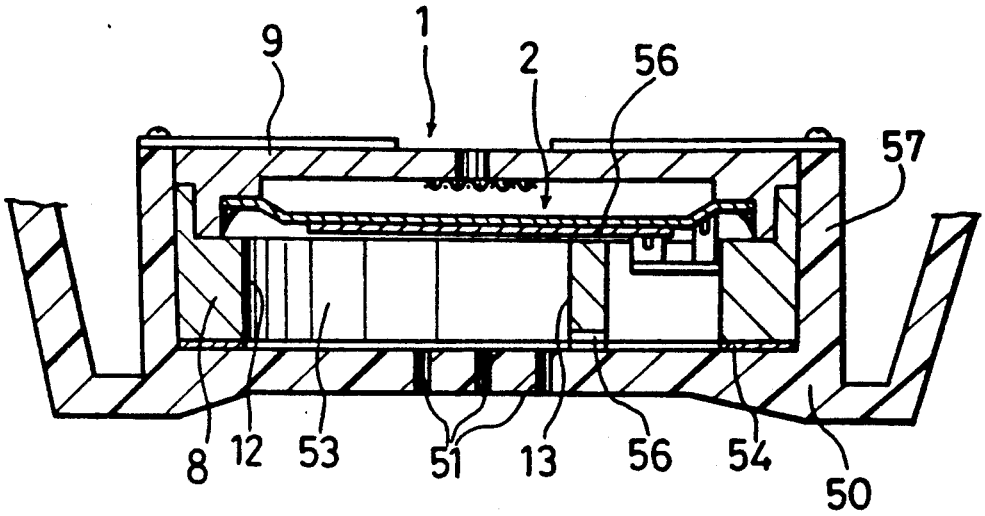
FIG. 16 is a view corresponding to FIG. 6 showing yet another embodiment.

A partition wall 13 may be formed as shown in FIG. 16, in a modification of the embodiment shown in FIG. 14.

Figure 17:
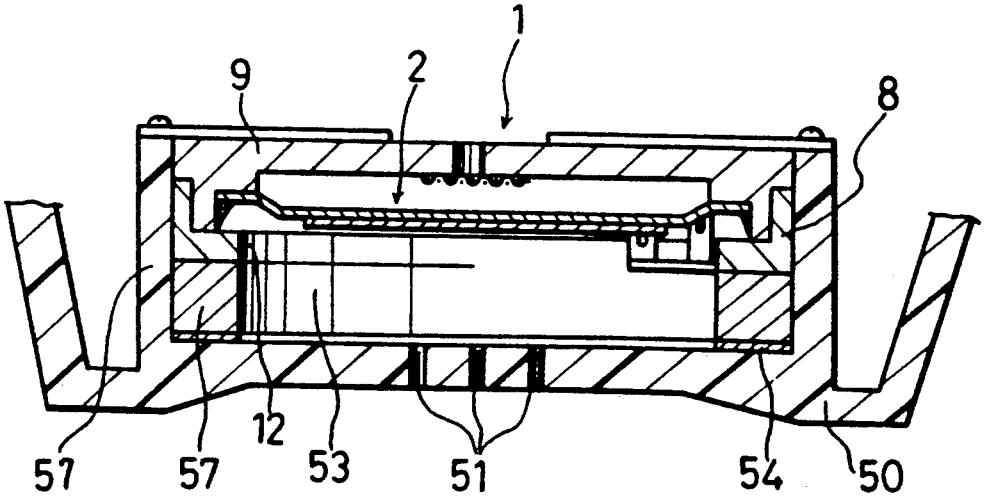
FIG. 17 is a view corresponding to FIG. 6 showing yet another embodiment.

Furthermore, as shown in FIG. 16 and FIG. 17, the leakage magnetic flux coil 3 may be omitted in an additional modification. Furthermore, as shown in FIG. 17, an annular spacer 57 for regulating the volume of the second cavity 53 may be inserted between the piezoelectric sound generator 1 and the rubber seat 54.

Various details of the invention may be changed without departing from its spirit nor its scope. Furthermore, the foregoing description of the embodiments according to the present invention is provided for the purpose of the illustration only, and not for the purpose of the limiting the invention as defined by the appended claims and their equivalents.

What is claimed is:

1. A piezoelectric sound generator comprising:

a piezoelectric device comprising a metal diaphragm and a piezoelectric porcelain plate affixed to said diaphragm, the piezoelectric device having a first electrode and a second electrode;

a first resistor having first and second terminals, said first terminal connected in series to the first electrode of said piezoelectric device;

a second resistor having first and second terminals, said first terminal connected in series to the second electrode of the piezoelectric device; and a leakage magnetic flux coil connected in parallel to said piezoelectric device and said second terminal of the first resistor and the second resistor, respectively.

2. A sound generator according to claim 1 further comprising connecting members to which said resistors are attached, for connecting said piezoelectric device with said coil.

3. A sound generator according to claim 2 further comprising a resin case including an encasing portion for retaining said piezoelectric device, a containing portion for containing said resistors, and a spool for retaining said coil.

4. A sound generator according to claim 3, wherein a portion of said connecting members is embraced by said resin case.

5. A piezoelectric sound generator comprising:

a piezoelectric device including a metal diaphragm and a piezoelectric porcelain plate affixed to said diaphragm, the piezoelectric device having a first electrode and a second electrode;

a first resistor having first and second terminals, said first terminal connected in series to the first electrode of the piezoelectric device;

a second resistor having first and second terminals, said first terminal connected in series to the second electrode of the piezoelectric device;

a leakage magnetic flux coil connected in parallel to said piezoelectric device and said second terminals of the first resistor and the second resistor, respectively; and a resin case including an encasing portion for retaining said piezoelectric device, a containing portion for containing said resistor, and a spool for retaining said coil.

6. A sound generator according to claim 5 further comprising connecting members to which said resistors are attached, for connecting said piezoelectric device with said coil.

7. A sound generator according to claim 6, wherein a portion of said connecting members is embraced by said resin case.

8. A sound generator according to claim 7, wherein said spool is located along the periphery of said resin case.

9. A piezoelectric sound generator which is contained by a handset of a telephone set comprising:

a piezoelectric device including a metal diaphragm and a piezoelectric porcelain plate affixed to said diaphragm, the piezoelectric device having a first electrode and a second electrode;

a first case containing said piezoelectric device and defining a first cavity with said piezoelectric device;

a second case jointed to said first case and defining a second cavity with said handset and said piezoelectric device, a first resistor having first and second terminals, said first terminal connected in series to the first electrode of the piezoelectric device, a second resistor having first and second terminals, said first terminal connected in series to the second electrode of the piezoelectric device, and a leakage magnetic flux coil connected in parallel to the piezoelectric device and said second terminals of the first resistor and the second resistor, respectively.

10. A sound generator according to claim 9, wherein said first case has an encasing portion for retaining said piezoelectric device containing portion for containing said pair of resistors, and a spool for retaining said coil.

11. A sound generator according to claim 10 further comprising connecting members to which said resistors are attached, for connecting said piezoelectric device with said leakage magnetic flux coil.

12. A sound generator according to claim 11, wherein said second case is made of resin and embraces a portion of said connecting members.

13. A sound generator according to claim 12, wherein said spool portion is located along the periphery of said second case.

14. A sound generator according to claim 9, wherein said second case further has a partition wall extending into said second cavity.

15. A sound generator according to claim 14, wherein said partition wall is adjacent said handset at a first gap and adjacent said piezoelectric device at a second gap.

16. A sound generator according to claim 15, in which the volumes of the divisions of said second cavity by said partition wall are in the ratio of $1:\frac{1}{2}-\frac{1}{4}$.

17. A piezoelectric sound generator comprising:

a piezoelectric device including a first electrode, a second electrode, a metal diaphragm and a piezoelectric porcelain plate affixed to said diaphragm;

a leakage magnetic flux coil;

connecting bodies to which electronic components are attached, for connecting said piezoelectric device with said coil;

a resin case having an encasing portion for retaining said piezoelectric device, a containing portion for containing said electronic components, and a spool portion for retaining said coil, a first resistor having first and second terminals, said first terminal connected in series to the first electrode of the piezoelectric device, a second resistor having first and second terminals, said first terminal connected in series to the second electrode of the piezoelectric device, and the leakage magnetic flux coil being connected in parallel to the piezoelectric device and said second terminals of the first resistor and the second resistor, respectively.

18. A sound generator according to claim 17, wherein a portion of said connecting bodies is embraced by said resin case.

19. A sound generator according to claim 18, wherein said connecting bodies have spring terminals and external connecting terminals.

20. A sound generator according to claim 19, wherein said spring terminals and said external connecting terminals have indentations for retaining said electronic components.

21. A sound generator according to claim 20, wherein said external connecting terminals have standing pins connected with said coil.

22. A piezoelectric receiver comprising:

a piezoelectric device including a first electrode, a second electrode, a metal diaphragm and a piezoelectric porcelain affixed to said diaphragm;

a support case containing said piezoelectric device so as to define a first cavity with said piezoelectric device;

a handset in which sound-emission holes are formed, containing said support case so as to define a second cavity with said piezoelectric device, a first resistor having first and second terminals, said first terminal connected in series to the first electrode of the piezoelectric device, a second resistor having first and second terminals, said first terminal connected in series to the second electrode of the piezoelectric device, and a leakage magnetic flux coil connected in parallel to the piezoelectric device and said second terminals of the first resistor and the second resistor, respectively.

23. A receiver according to claim 22 further comprising connecting members, connected to said piezoelectric device, to which the first and second resistors are attached.

24. A receiver according to claim 22, wherein said support case has an encasing portion for retaining said piezoelectric device, a containing portion for containing said resistors, and a spool for retaining said coil.

25. A receiver according to claim 24 further comprising connecting members to which said resistors are attached, for connecting said piezoelectric device with said coil.

26. A receiver according to claim 25, wherein said support case is made of resin and embraces a portion of said connecting members.

27. A receiver according to claim 26, wherein said connecting members have spring terminals and external connecting terminals.

28. A receiver according to claim 27, wherein said connecting members have indentations into which said resistors are mounted.

29. A receiver according to claim 28, wherein said connecting members have standing pins for connection with said coil.

30. A receiver according to claim 22, wherein said support case also has a partition wall extending into said second cavity.

31. A receiver according to claim 30, wherein said handset has a portion including said sound emission holes, and an cylindrically extending ring formed integrally around said portion including said sound emission holes.

32. A receiver according to claim 31, wherein said partition wall is adjacent said handset at a first gap and adjacent said piezoelectric device at a second gap.

33. A receiver according to claim 32, in which the volumes of the divisions of said second cavity by said partition wall are in the ratio of $1:\frac{1}{2}-1:\frac{1}{4}$.

34. A receiver according to claim 33 further comprising a rubber seat provided between said support case and said portion including said sound emission holes, sealing a space between said support case and said handset.

35. A receiver according to claim 34 further comprising an angular spacer placed between said support case and said rubber sheet.

* * * * *